US010893741B1

(12) United States Patent
Lim et al.

(10) Patent No.: US 10,893,741 B1
(45) Date of Patent: Jan. 19, 2021

(54) BULLETPROOF BAG

(71) Applicants: ChaeHyun Lim, Seoul (KR); Seung Phill Lim, Seoul (KR)

(72) Inventors: ChaeHyun Lim, Seoul (KR); Seung Phill Lim, Seoul (KR)

( * ) Notice: Subject to any disclaimer, the term of this patent is extended or adjusted under 35 U.S.C. 154(b) by 0 days.

(21) Appl. No.: 16/578,211

(22) Filed: Sep. 20, 2019

(30) Foreign Application Priority Data

Jul. 22, 2019 (KR) ..... 10-2019-0088292

(51) Int. Cl.
*A45F 4/02* (2006.01)
*F41H 1/02* (2006.01)

(52) U.S. Cl.
CPC *A45F 4/02* (2013.01); *F41H 1/02* (2013.01)

(58) Field of Classification Search
CPC ..... A45F 4/02; F41H 1/02
USPC ..... 224/576
See application file for complete search history.

(56) References Cited

U.S. PATENT DOCUMENTS 5,797,140 A * 8/1998 Davis ..... F41H 1/02 2/2.5
6,161,738 A * 12/2000 Norris ..... A45C 9/00 109/49.5
6,419,132 B1 * 7/2002 Reed ..... A45C 15/00 109/49.5
6,685,071 B2 * 2/2004 Prather ..... A45C 15/00 2/2.5
9,351,557 B2 * 5/2016 Inouye ..... A45F 3/06
9,801,452 B2 * 10/2017 Duthoit ..... F41H 1/02
9,802,558 B2 * 10/2017 Namou ..... B60L 3/0046
10,188,197 B2 * 1/2019 Fraile Nuez ..... F41H 1/02
10,213,008 B2 * 2/2019 Weaver, Jr. ..... A45F 3/06
2007/0262103 A1 * 11/2007 Blakley ..... A45B 11/02 224/190
2007/0266469 A1 11/2007 Blakeley ..... 2/2.5
2009/0014490 A1 * 1/2009 Bradley ..... A45C 13/008 224/576
2015/0196077 A1 * 7/2015 McIntire, Jr. ..... A41D 13/0518 2/2.5
2017/0332768 A1 * 11/2017 Fraile Nuez ..... A45F 3/06

FOREIGN PATENT DOCUMENTS

WO WO 03/003531 A1 1/2003
WO WO 03/062736 A1 7/2003

* cited by examiner

*Primary Examiner* — Peter N Helvey
(74) *Attorney, Agent, or Firm* — Stein IP, LLC

(57) ABSTRACT

Disclosed herein is a bulletproof bag. A bulletproof bag according to one embodiment of the present invention includes: a frame which supports the rear side of a bag; a body which is coupled to the outside of the frame and forms an accommodation space; shoulder straps which are coupled to the body and worn on the shoulders of a user; a zipper part which extends from both sides of the bottom of the body to the center of the bottom of the body and extends along the center portion of the outer side of the body; and string guide holders which guide strings through their movement; wherein when ends of the strings are pulled, the sliders of the zipper part are moved, the zipper part is opened, and finally the body is changed into a state of being able to be worn to protect the user.

10 Claims, 7 Drawing Sheets

BULLETPROOF BAG

CROSS-REFERENCE TO RELATED APPLICATION

This application claims the benefit of Korean Patent Application No. 10-2019-0088292 filed on Jul. 22, 2019, which is hereby incorporated by reference herein in its entirety.

BACKGROUND

1. Technical Field

The present invention relates generally to a bulletproof bag, and more specifically to a bulletproof bag which can be changed into and used as a bulletproof jacket when the bulletproof bag is spread out from a bag state.

2. Description of the Related Art

Protective equipment used to protect a human life by blocking bullets, explosion fragments, sword attacks or the like, such as a bulletproof jacket or protective vest, is configured to cover the fatal part of a human body with bulletproof or protective plates each formed by inserting a bulletproof or protective material into an outer cover and sewing them.

Examples of bag-type protective equipment are disclosed in International Patent Publication Nos. WO 03/003531 and WO 03/062736.

Conventionally known protective bags, including those disclosed in the above publications, are each configured such that extension cover-type protective plates are attached to the outer sides of the front and back protective plates of a bag and the bag is placed to cover or spread out. Furthermore, the conventional known protective bags are each configured to be worn in order to cover the chest and back parts of a user.

Bags are tools designed to accommodate and carry various items, such as books, files, clothes, etc. Bags are used to carry items with the types and uses thereof classified. During walking, bags carry items, and are worn on the shoulders of users. Bags have an advantage of being convenient during movement.

Recently, in order to prepare for an emergency situation, such as a firearm accident, in an unexpected place, bag-type protective equipment has been proposed because it is difficult to carry common protective equipment to protect a human life at all times.

However, the conventional protective bags are problematic in that it is impossible to rapidly spread them out in an emergency situation because they can be spread out after protective plates have been detached or connected upon use and in that they have complicated structures. Furthermore, when users wear the conventional protective bags, they suffer from difficulties in acting freely. Therefore, there is a demand for protective equipment which can be conveniently used and can ensure safety.

SUMMARY

The present invention has been conceived to overcome the above-described problems, and one embodiment of the present invention is intended to provide a bulletproof bag which is easy to carry and which can be spread out by a convenient simple operation to thus respond to an emergency situation rapidly and protect a human life.

According to an aspect of the present invention, there is provided a bulletproof bag including: a frame which supports the rear side of a bag; a body which is coupled to the outside of the frame, and which forms an accommodation space; shoulder straps which are coupled to the body, and which are worn on the shoulders of a user; a zipper part which extends from both sides of the bottom of the body to the center of the bottom of the body and which further extends along the center portion of the outer side of the body; and string guide holders which guide strings, first ends of which are connected to respective sliders constituting part of the zipper part, through their movement; wherein when the remaining ends of the strings are pulled, the sliders of the zipper part are moved, the zipper part is opened, and finally the body is spread out and changed into a state of being able to be worn to protect the front and rear sides of the user.

The frame may be provided along the outer circumferential portions of the surface of the body which comes into contact with the back of the user.

The remaining ends of the strings may be extended and located on the shoulder straps.

The zipper part may include: a left zipper part which is located on a left side based on the front side of the body; and a right zipper part which is opposite to the left zipper part.

The left zipper part and the right zipper part may selectively couple and separate the left front and right front portions of the body to and from each other.

The string guide holders may be provided in the body along the zipper part.

Slits having a width smaller than the diameter of the strings may be formed in the respective string guide holders toward the zipper part.

Cutouts may be formed in the upper sides of both the side portions of the body in order to allow shoulder parts to be smoothly moved.

A mesh sack which accommodates personal belongings of the user may be provided inside the body.

According to another aspect of the present invention, there is provided a bulletproof bag including: a frame which supports the rear side of a bag; a body which is coupled to the outside of the frame; shoulder straps which are coupled to a front side of the body, and which are worn on the shoulders of a user; a zipper part which is provided along the center portion of the outer side of the body in a straight line; and string guide holders which guide strings, first ends of which are connected to respective sliders constituting part of the zipper part, through their movement; wherein when the remaining ends of the strings are pulled, the sliders of the zipper part are moved, the zipper part is opened, and finally the body is spread out and changed into a state of being able to be worn to protect the front and rear sides of the user.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

The following embodiments are provided merely to help those skilled in the art easily understand the technical spirit of the present invention, and the present invention is not limited to these embodiments. Furthermore, the items illustrated in the accompanying drawings are items illustrated to easily describe embodiments of the present invention, and may be different from actually implemented items.

It should be understood that when one component is described as being "connected" or "coupled" to another component, the one component may be directly connected or coupled to the other component or a third component may be interposed between the two components.

Figure 1:
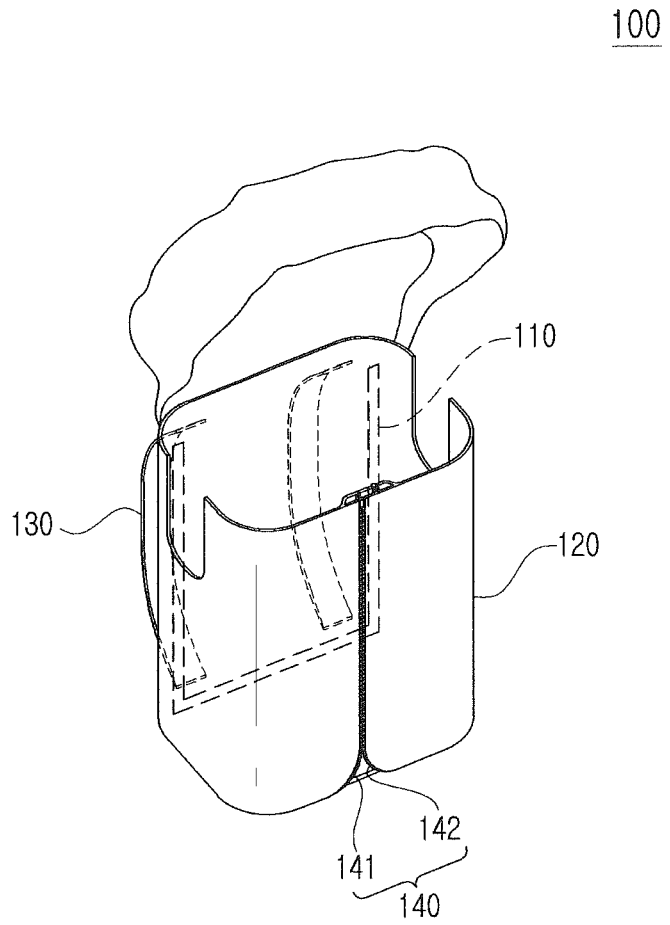
FIG. 1 is a schematic diagram of a bulletproof bag according to one embodiment of the present invention.
Figure 2:
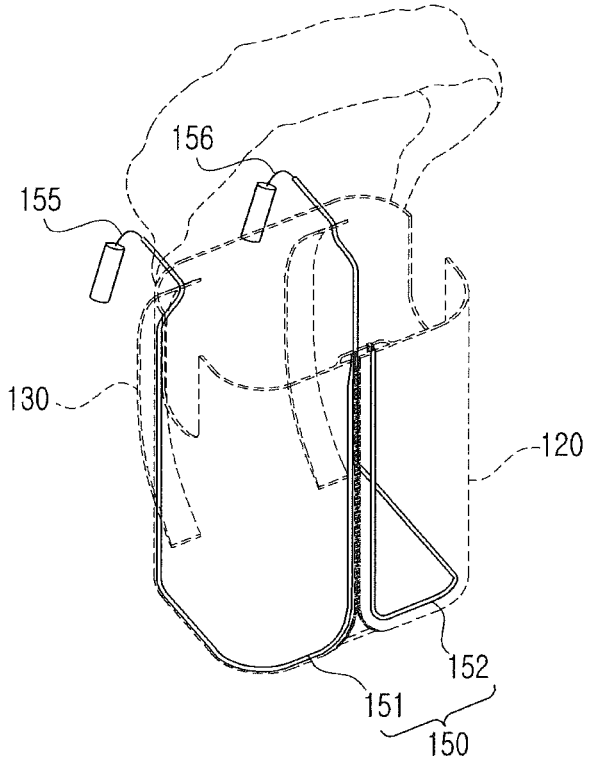
FIG. 2 is another schematic diagram of the bulletproof bag according to the embodiment of the present invention, which is shown in FIG. 1.
Figure 3:
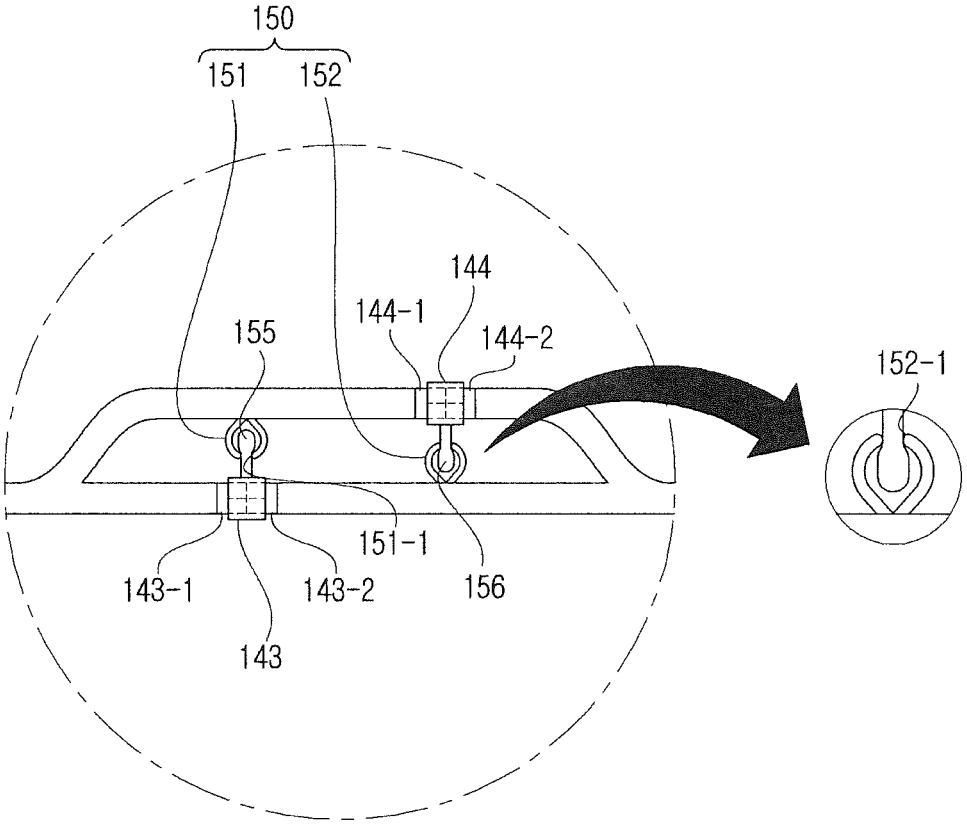
FIG. 3 is a partially enlarged schematic plan view of portion A of FIG. 2.
Figure 4:
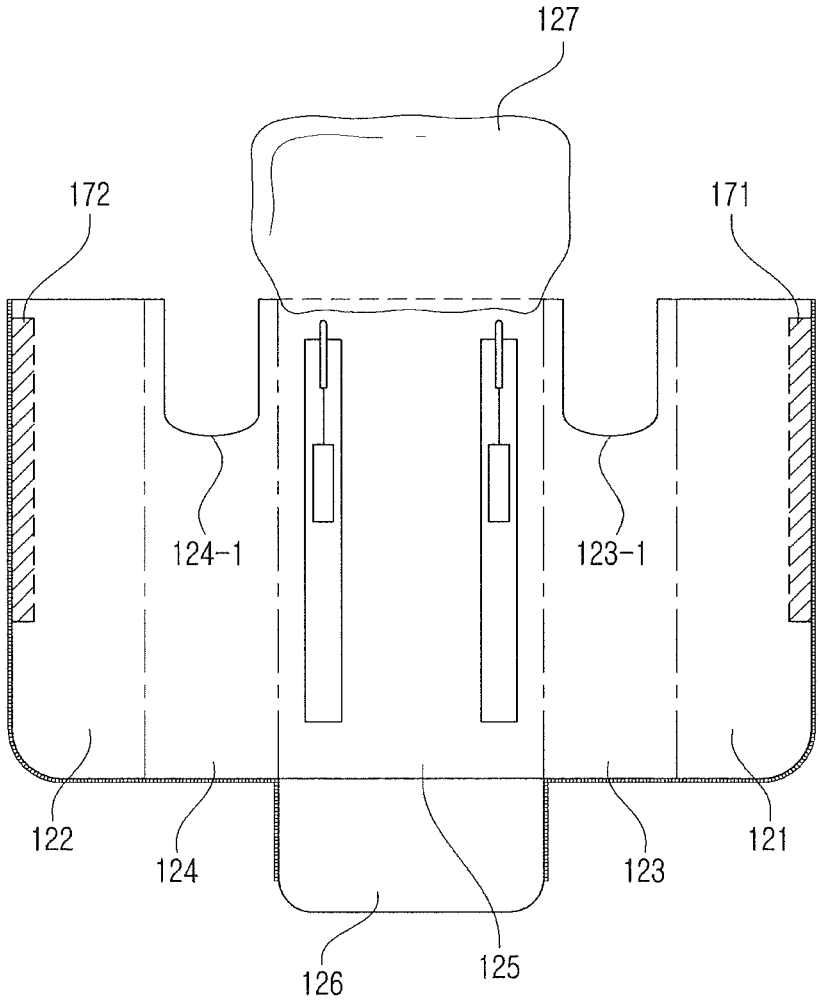
FIG. 4 is a schematic planer figure of the bulletproof bag according to the embodiment of the present invention, which is shown in FIG. 1.

FIG. 1 is a schematic diagram of a bulletproof bag according to one embodiment of the present invention, FIG. 2 is another schematic diagram of the bulletproof bag according to the embodiment of the present invention, which is shown in FIG. 1, FIG. 3 is a partially enlarged schematic plan view of portion A of FIG. 2, and FIG. 4 is a schematic planer figure of the bulletproof bag according to the embodiment of the present invention, which is shown in FIG. 1.

Referring to FIGS. 1 to 4 together, a bulletproof bag 100 according to one embodiment of the present invention includes: a frame 110 which supports the rear side of a bag; a body 120 which is coupled to the outside of the frame 110, and which forms an accommodation space; shoulder straps 130 which are coupled to the back of the body 120, and which are worn on the shoulders of a user; a zipper part 140 which extends from both sides of the bottom of the body 120 to the center of the bottom of the body 120 and which further extends along the center portion of the outer side of the body 120; and string guide holders 150 which guide strings 155 and 156, first ends of which are connected to respective sliders 143 and 144 constituting part of the zipper part 140, through their movement. In this case, when the remaining ends of the strings 155 and 156 are pulled, the sliders 143 and 144 of the zipper part 140 are moved, the zipper part 140 is opened, and finally the body 120 is spread out and changed into a state of being able to be worn to protect the front and rear sides of the user.

In one specific example, the frame 110 is provided along the outer circumferential portions of the surface of the body 120 which comes into contact with the back of a user. In this case, the frame 110 preferably has a U shape or hollow rectangular shape.

In this case, the term "front" is determined when a third person views a user who wears the bulletproof bag 100, and a rear portion is opposite to the front portion.

The body 120 includes a left front portion 121, a right front portion 122, a left portion 123, a right portion 124, a rear portion 125, a bottom portion 126, and a cover portion 127. Protective plates configured to block bullets, explosion fragments, or the like are provided in the left front portion 121, the right front portion 122, the left portion 123, the right portion 124, the rear portion 125, the bottom portion 126, and the cover portion 127, respectively.

In this case, cutouts 123-1 and 124-1 are formed in the upper sides of both the side portions 123 and 124 of the body 120 in order to allow the shoulder parts to be smoothly moved.

The cover portion 127 covers the top opening of the body 120, and is bent forward and protects the head of a user when spread in case of emergency. Furthermore, when the bottom portion 126 is spread, it is separated from the left front portion 121, the right front portion 122, the left portion 123 and the right portion 124, and protects the buttocks of the user.

In addition, a mesh sack 160 (see FIG. 5) which forms an accommodation space in order to accommodate personal belongings of the user is provided in the accommodation space inside the body 120, and prevents the personal belongings of the user from being lost or falling down when the body 120 is spread out.

According to the present invention, the remaining ends of the strings 155 and 156, the first ends of which are connected to the sliders 143 and 144 of the zipper part 140, are extended to and located on the shoulder straps 130.

Furthermore, the zipper part 140 includes: a left zipper part 141 which is located on a left side based on the front side of the body 120; and a right zipper part 142 which is opposite to the left zipper part 141. Accordingly, the left zipper part 141 and the right zipper part 142 selectively couple and separate the left front portion 121 and the right front portion 122 to and from each other. In other words, the left slider 143 of the left zipper part 141 selectively couples and separates left zipper couplings 143-1 and 143-2 to and from each other, and the right slider 144 selectively couples and separates the right zipper couplings 144-1 and 144-2 of the right zipper part 142 to and from each other.

The string guide holders 150 include a left string guide holder 151 and a right string guide holder 152, and are provided in the body 120 along the zipper part 140. In this case, slits 151-1 and 152-1 having a width smaller than the diameter of the strings 155 and 156 are formed along the respective string guide holders 150 toward the zipper part 140.

Meanwhile, Velcro portions 171 and 172 are provided on the left front portion 121 and right front portion 122 of the body 120, respectively. When a user wears the bulletproof bag, the bulletproof bag is worn and fastened using the Velcro portions 171 and 172.

Figure 5:
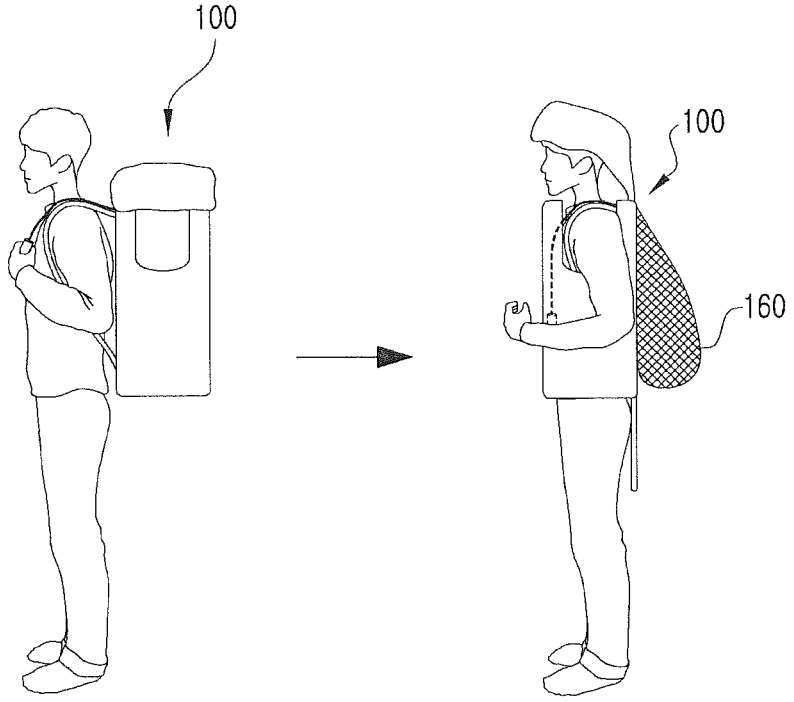
FIG. 5 is a schematic diagram showing an example of the use of the bulletproof bag according to the embodiment of the present invention.

FIG. 5 is a schematic diagram showing an example of the use of the bulletproof bag according to the embodiment of the present invention.

Referring to FIG. 5 together with FIGS. 1 to 4, the operation of the bulletproof bag 100 according to the embodiment of the present invention will be described. First, items, such as books, etc., are accommodated in the accommodation space of the body 120, and then the bulletproof bag 100 is worn on the shoulders of a user by using the shoulder straps 130.

When an emergency situation, such as a firearm accident, occurs, the strings 155 and 156 located on the shoulder straps 130 are pulled downward. When the strings 155 and 156 are pulled, the sliders 143 and 144 are pulled because the strings 155 and 156 are coupled to the sliders 143 and 144 of the zipper part 140.

In this case, the zipper part 140 is continuously opened without being stuck via the string guide holders 151 and 152 which guide the strings 155 and 156 through their movement. In this case, the zipper part 140 includes the left zipper part 141 and the right zipper part 142. The left zipper part 141 releases the zipper coupling between the left lower end portion of the front portion and the lower end portion of the left portion 123 in the center portion of the front portion of the body 120, and the right zipper part 142 releases the zipper coupling between the right lower end portion of the front portion and the lower end portion of the right portion 124 in the center portion of the front portion of the body 120.

When the zipper part 140 is opened, the body 120 is spread out, and the Velcro portions 171 and 172 provided on the left front portion 121 and the right front portion 122 are fastened by coupling them to each other on the chest area of a user.

Furthermore, the cover portion 127 is bent forward and protects the head of a user, and the bottom portion 126 is hung down and protects the buttocks of the user.

In this case, items, such as books, etc., are accommodated inside the mesh sack 160 of the body 120, and thus the personal belongings of a user are prevented from being lost.

Figure 6:
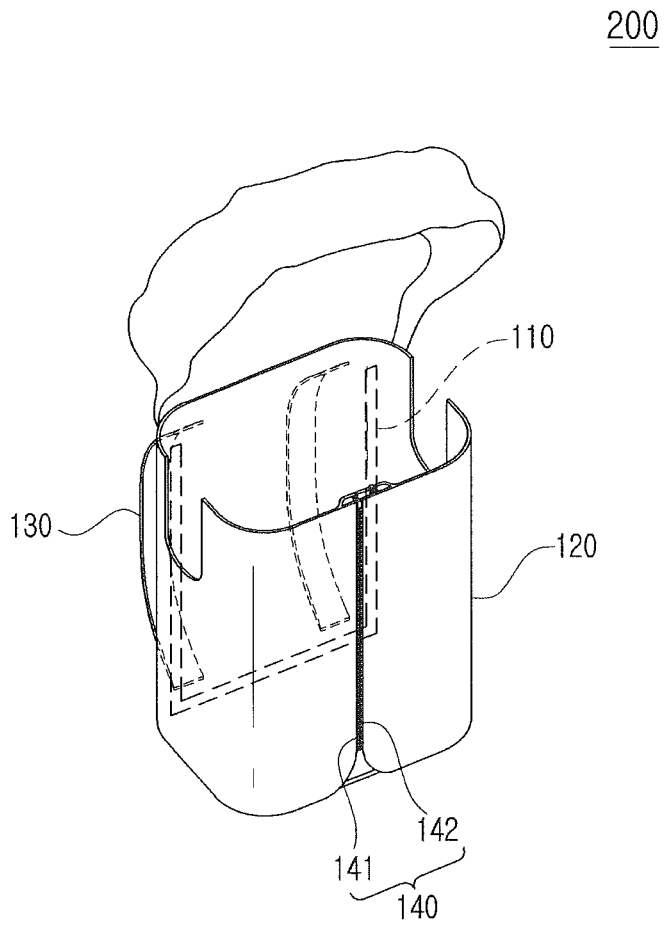
FIG. 6 is a schematic diagram of a bulletproof bag according to another embodiment of the present invention.
Figure 7:
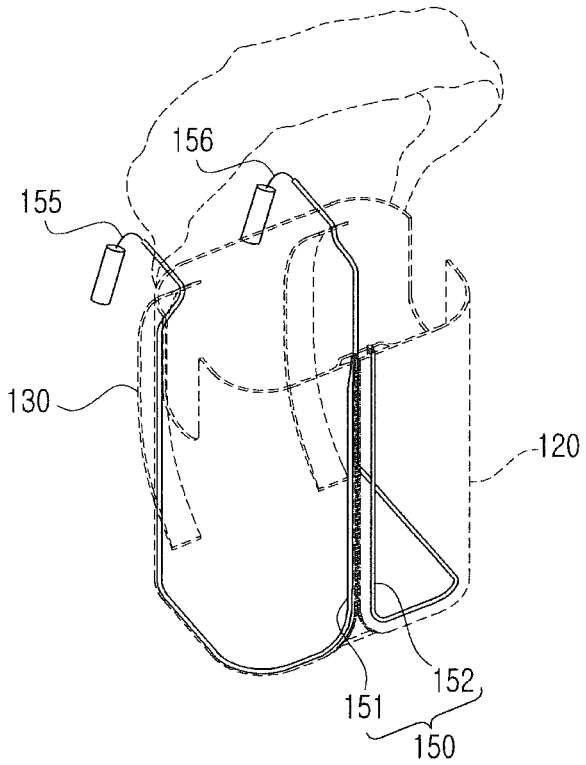
FIG. 7 is another schematic diagram of the bulletproof bag according to the embodiment of the present invention, which is shown in FIG. 6.

FIG. 6 is a schematic diagram of a bulletproof bag according to another embodiment of the present invention, and FIG. 7 is another schematic diagram of the bulletproof bag according to the embodiment of the present invention, which is shown in FIG. 6.

Referring to FIGS. 6 and 7 together, a bulletproof bag 200 according to another embodiment of the present invention includes: a frame 110 which supports the rear side of a bag; a body 120 which is coupled to the outside of the frame 110, and which forms an accommodation space; shoulder straps 130 which are coupled to the body 120, and which are worn on the shoulders of a user; a zipper part 140 which extends from both sides of the bottom of the body 120 and along the center portion of the outer side of the body 120 in a straight line; and string guide holders 150 which guide strings 155 and 156, first ends of which are connected to respective sliders constituting part of the zipper part 140, through their movement. In this case, when the remaining ends of the strings 155 and 156 are pulled, the sliders of the zipper part 140 are moved, the zipper part 140 is opened, and finally the body 120 is spread out and changed into a state of being able to be worn to protect the front and rear sides of the user.

In one specific example, the zipper part 140 includes a left zipper part 141 and a right zipper part 142. The zipper part 140 is provided along the center portion of the outside of the body 120 in a straight line. In this case, the direction in which the zipper part 140 is opened may be the opposite direction.

The string guide holders 150 include a left string guide holder 151 and a right string guide holder 152. The string guide holders 150 may be located in the upper portion of the body 120 in order to open the zipper part 140. Redundant descriptions of all configurations except for the configuration in which the zipper part 140 is provided in a straight line will be omitted.

Therefore, the bulletproof bag according to the present invention can protect a human life when a firearm accident occurs, and can particularly protect not only the back of a user but also the front, head and buttocks of the user. Furthermore, the bulletproof bag can be changed from a bag form into a bulletproof protection gear without requiring separate equipment, the bulletproof bag can be rapidly spread out when an emergency situation occurs, and a user can act freely without inconvenience after the user has worn the bulletproof bag.

According to the present invention, the bulletproof bag has the following advantages:

First, when a firearm accident occurs, a life can be protected.

Second, not only the back of a user but also the front, head and buttocks of the user can be protected.

Three, the bulletproof bag can be changed from a bag form into a bulletproof protection gear without requiring separate equipment.

Fourth, when an emergency situation occurs, the bulletproof bag can be spread out rapidly.

Fifth, after a user has worn the bulletproof bag, the user can act freely without inconvenience.

It will be appreciated by those having ordinary skill in the art to which the present invention pertains that the present invention may be practiced in other specific forms without changing the technical spirit or essential features thereof. Therefore, it should be noted that the above-described embodiments are merely embodiments selected and presented in order to help the understanding of those skilled in the art, so that the technical spirit of the present invention is not necessarily limited only to the presented embodiments, and various alterations, additions, modifications and other equivalent embodiments may be made without departing from the technical spirit of the present invention.

What is claimed is:

1. A bulletproof bag comprising:

a frame which supports a rear side of a bag;

a body which is coupled to an outside of the frame, and which forms an accommodation space;

shoulder straps which are coupled to the body, and which are worn on shoulders of a user;

a zipper part which extends from both sides of a bottom of the body to a center of the bottom of the body and which further extends along a center portion of an outer side of the body; and string guide holders which guide strings, first ends of which are connected to respective sliders constituting part of the zipper part, through their movement;

wherein when remaining ends of the strings are pulled, the sliders of the zipper part are moved, the zipper part is opened, and finally the body is spread out and changed into a state of being able to be worn to protect front and rear sides of the user.

2. The bulletproof bag of claim 1, wherein the frame is provided along outer circumferential portions of a surface of the body which comes into contact with a back of the user.

3. The bulletproof bag of claim 1, wherein the remaining ends of the strings are extended and located on the shoulder straps.

4. The bulletproof bag of claim 1, wherein the zipper part comprises:

a left zipper part which is located on a left side based on a front side of the body; and a right zipper part which is opposite to the left zipper part.

5. The bulletproof bag of claim 4, wherein the left zipper part and the right zipper part selectively couple and separate left front and right front portions of the body to and from each other.

6. The bulletproof bag of claim 1, wherein the string guide holders are provided in the body along the zipper part.

7. The bulletproof bag of claim 6, wherein slits having a width smaller than a diameter of the strings are formed in the respective string guide holders toward the zipper part.

8. The bulletproof bag of claim 1, wherein cutouts are formed in upper sides of both side portions of the body in order to allow shoulder parts to be smoothly moved.

9. The bulletproof bag of claim 1, wherein a mesh sack which accommodates personal belongings of the user is provided inside the body.

10. A bulletproof bag comprising:

a frame which supports a rear side of a bag;

a body which is coupled to an outside of the frame;

shoulder straps which are coupled to a front side of the body, and which are worn on shoulders of a user;

a zipper part which is provided along a center portion of an outer side of the body in a straight line; and string guide holders which guide strings, first ends of which are connected to respective sliders constituting part of the zipper part, through their movement;

wherein when remaining ends of the strings are pulled, the sliders of the zipper part are moved, the zipper part is opened, and finally the body is spread out and changed into a state of being able to be worn to protect front and rear sides of the user.

* * * * *